US008317496B2

(12) United States Patent
Finkenbinder

(10) Patent No.: US 8,317,496 B2
(45) Date of Patent: Nov. 27, 2012

(54) MOTOR-FAN ASSEMBLY HAVING A TAPERED FAN WITH A CONCAVE UNDERSIDE

(75) Inventor: David B. Finkenbinder, Ravenna, OH (US)

(73) Assignee: Ametek, Inc., Paoli, PA (US)

( * ) Notice: Subject to any disclaimer, the term of this patent is extended or adjusted under 35 U.S.C. 154(b) by 421 days.

(21) Appl. No.: 12/716,696

(22) Filed: Mar. 3, 2010

(65) Prior Publication Data

US 2011/0217187 A1 Sep. 8, 2011

(51) Int. Cl.

| | |
|---|---|
| ***F04B 35/04*** | (2006.01) |
| ***F04D 29/44*** | (2006.01) |
| ***B63H 1/16*** | (2006.01) |

(52) U.S. Cl. ..... 417/423.14; 415/199.3; 415/208.2; 415/211.2; 416/188

(58) Field of Classification Search ..... 417/423.14; 415/208.2, 211.2, 199.1–199.3; 416/186 R, 416/188

See application file for complete search history.

(56) References Cited

U.S. PATENT DOCUMENTS

| | | | | |
|---|---|---|---|---|
| 4,621,991 | A | 11/1986 | Smith et al. | 417/423 A |
| 5,296,769 | A | 3/1994 | Havens et al. | 310/90 |
| 6,166,462 | A | 12/2000 | Finkenbinder et al. | 310/63 |
| 6,439,843 | B1 | 8/2002 | Finkenbinder | 415/172.1 |
| 6,695,580 | B2 | 2/2004 | Finkenbinder | 415/208.3 |
| 6,703,754 | B1 | 3/2004 | Finkenbinder et al. | 310/227 |
| 6,884,037 | B2 * | 4/2005 | Lacey et al. | 416/214 R |
| 7,091,635 | B1 | 8/2006 | Gilliland et al. | 310/62 |
| 7,132,777 | B2 | 11/2006 | Finkenbinder et al. | 310/239 |
| 2008/0206050 | A1 * | 8/2008 | Finkenbinder et al. | 415/208.2 |
| 2009/0179426 | A1 * | 7/2009 | Alvarez et al. | 290/54 |
| 2009/0191061 | A1 * | 7/2009 | Lacey et al. | 416/214 R |

* cited by examiner

*Primary Examiner* — Charles Freay
(74) *Attorney, Agent, or Firm* — Renner Kenner Greive Bobak Taylor & Weber

(57) ABSTRACT

A motor-fan unit includes an end plate assembly, a motor assembly supported by the end plate assembly, and a shaft rotated by the motor assembly and extending through the end plate assembly. The fan assembly further includes a fan secured to the rotatable shaft which is supported by the end plate assembly. The fan includes a fan disc having a substantially frusto-conical shape, a fan ring having a substantially frusto-conical shape, and a plurality of vanes connecting the fan disc to the fan ring such that the frusto-conical shapes are substantially parallel to one another. A diffuser with a tapered fan side is also provided between the fan and the end plate assembly, wherein the tapered fan side is substantially parallel with the fan disc.

9 Claims, 5 Drawing Sheets

FIG-5
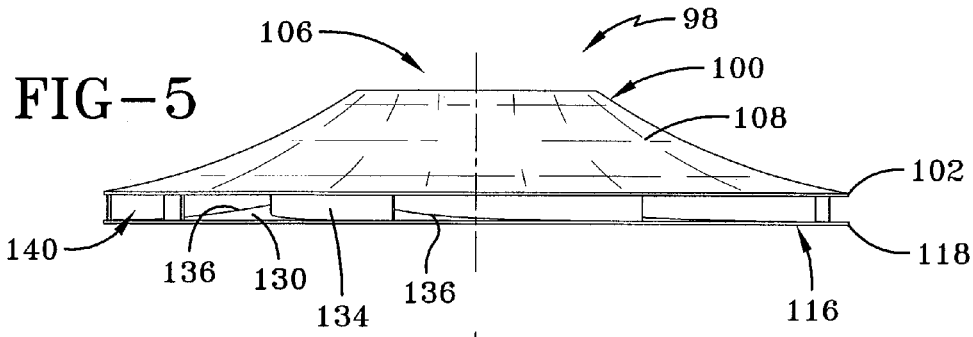
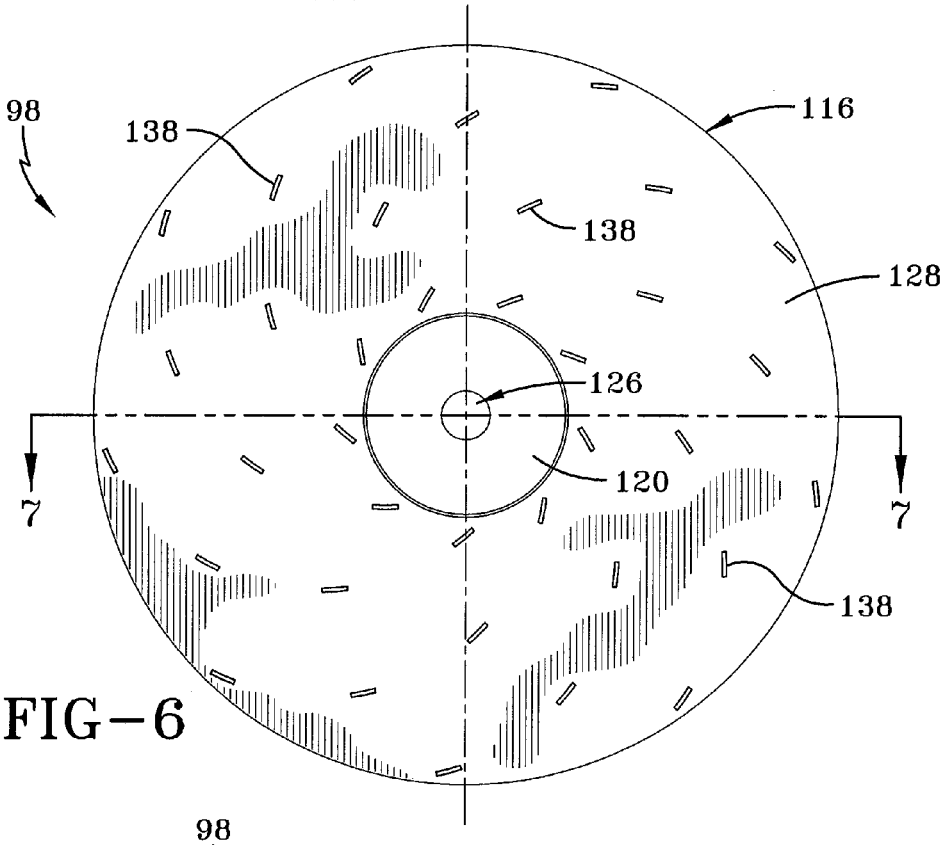
FIG-6
FIG-7
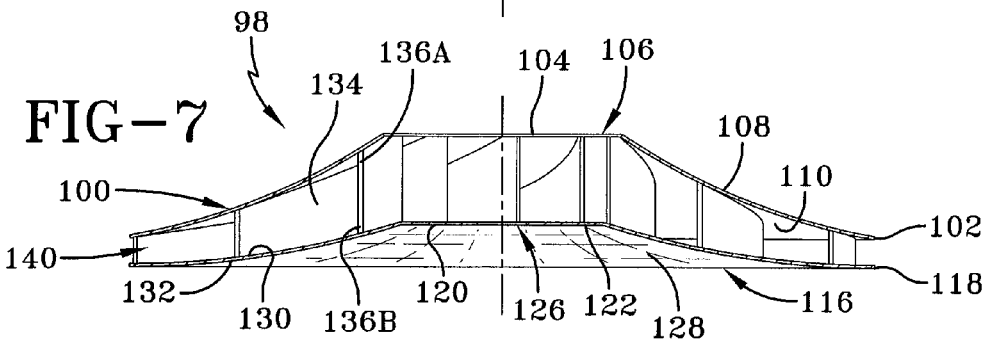

MOTOR-FAN ASSEMBLY HAVING A TAPERED FAN WITH A CONCAVE UNDERSIDE

TECHNICAL FIELD

The present invention generally relates to fans used in association with various motor-fan systems. More particularly, the present invention relates to a motor-fan assembly having a fan with a concave underside.

BACKGROUND OF THE INVENTION

Electric motors are well known in the art and have been put to use in a variety of applications, including the handling of air. In this circumstance, an electric motor is coupled to a fan, creating a motor-fan unit, which produces an airflow as needed. When providing air movement, the motor-fan unit may supply cooling air to the motor, so as to maintain the motor's operating temperature at an optimal level, allowing the motor's operating life to be extended. The motor-fan unit may also be used to generate working air for vacuum type devices.

To achieve this effect, the fan is mounted on a motor driven shaft, which draws air into a fan shroud. The fan shroud compresses or pressurizes the incoming air, which is resultantly released into the motor housing via one or more ports in a diffuser plate, causing the air to be directed toward the motor windings. As a result, the heat from the motor is drawn into the airflow and exhausted from the motor housing, thus enhancing the motor's operating life. In other embodiments, air passing through the diffuser plate may be collected and routed through a single radial and tangentially extending exhaust port.

In order to efficiently operate the motor-fan assembly, it is important to have efficient air flow through the assembly. In this regard, it has been determined that prior art fan constructions may utilize flat fan rings and a flat fan disc which are parallel to one another and connected to one another by a plurality of curvilinear vanes. This has been improved upon by providing a tapered or convex fan ring and a flat fan ring which allows for more collection of air within the fan before it is exhausted out through the diffuser and a motor assembly. However, it is believed that such a configuration is not as efficient as it could be. Indeed, after the air is drawn into the fan through the fan ring, the collected air is required to make a sharp right angle turn by the flat fan ring. And it is believed that the convex ring/flat disc configuration allows for "dead space" to form within the confines of the fan. This allows small turbulent air currents to develop within the fan assembly as it rotates. These small air currents interfere with or flow against the predominate air flow pattern. Moreover, at some rotational speeds, the sharp turning of the air and resulting turbulent air currents causes air to back up and significantly slow entry of air into the fan. As a result, the fan vanes generate additional noise further hindering performance of the motor-fan assembly. As such, air does not efficiently move through the fan assembly, causing the motor assembly to work harder and consume more power. Moreover, the small air currents that exist within the fan unit may allow for dust and water-born debris to accumulate around the connection between the fan assembly and a motor shaft. As such, this accumulation of moisture may migrate into the bearing area and cause the bearing to abnormally degrade.

Another detriment to fan assemblies which utilize a rotating fan with a flat fan ring is that the length of the motor shaft is extended. At critical speeds, an extended length motor shaft begins to flex resulting in significant operational deficiencies.

Therefore, there is a need for a motor-fan unit a fan assembly that utilizes a tapered fan having a concave underside. Such a configuration allows for efficient movement of air through the fan assembly without generation of deleterious airflow patterns. In other words, there is a need for a fan which moves air through the fan assembly without any lingering air current flows developing which would adversely effect operation of the motor-fan unit. And there is a need for a motor-fan unit which decreases the axial length of the motor to reduce shaft flexing and improve performance of the motor.

SUMMARY OF THE INVENTION

In light of the foregoing, it is a first aspect of the present invention to provide a motor-fan assembly having a fan with a concave underside.

It is another aspect of the present invention to provide a motor-fan unit comprising an end plate assembly, a motor assembly supported by the end plate assembly, a shaft rotated by the motor assembly and extending through the end plate assembly, and a fan assembly supported by the end plate assembly, the fan assembly comprising a fan secured to the rotatable shaft, the fan comprising a fan disc having a substantially frusto-conical shape, a fan ring having a substantially frusto-conical shape, and a plurality of vanes connecting the fan disc to the fan ring such that the frusto-conical shapes are substantially parallel to one another.

BRIEF DESCRIPTION OF THE DRAWINGS

These and other features and advantages of the present invention will become better understood with regard to the following description, appended claims, and accompanying drawings where:

FIG. 5 is a side elevational view of the fan shown in FIG. 3;

FIG. 6 is a bottom view of the fan shown in FIG. 3; and

FIG. 7 is a cross-sectional view of the fan taken along lines 7-7 of FIG. 6.

BEST MODE FOR CARRYING OUT THE INVENTION

Figure 1:
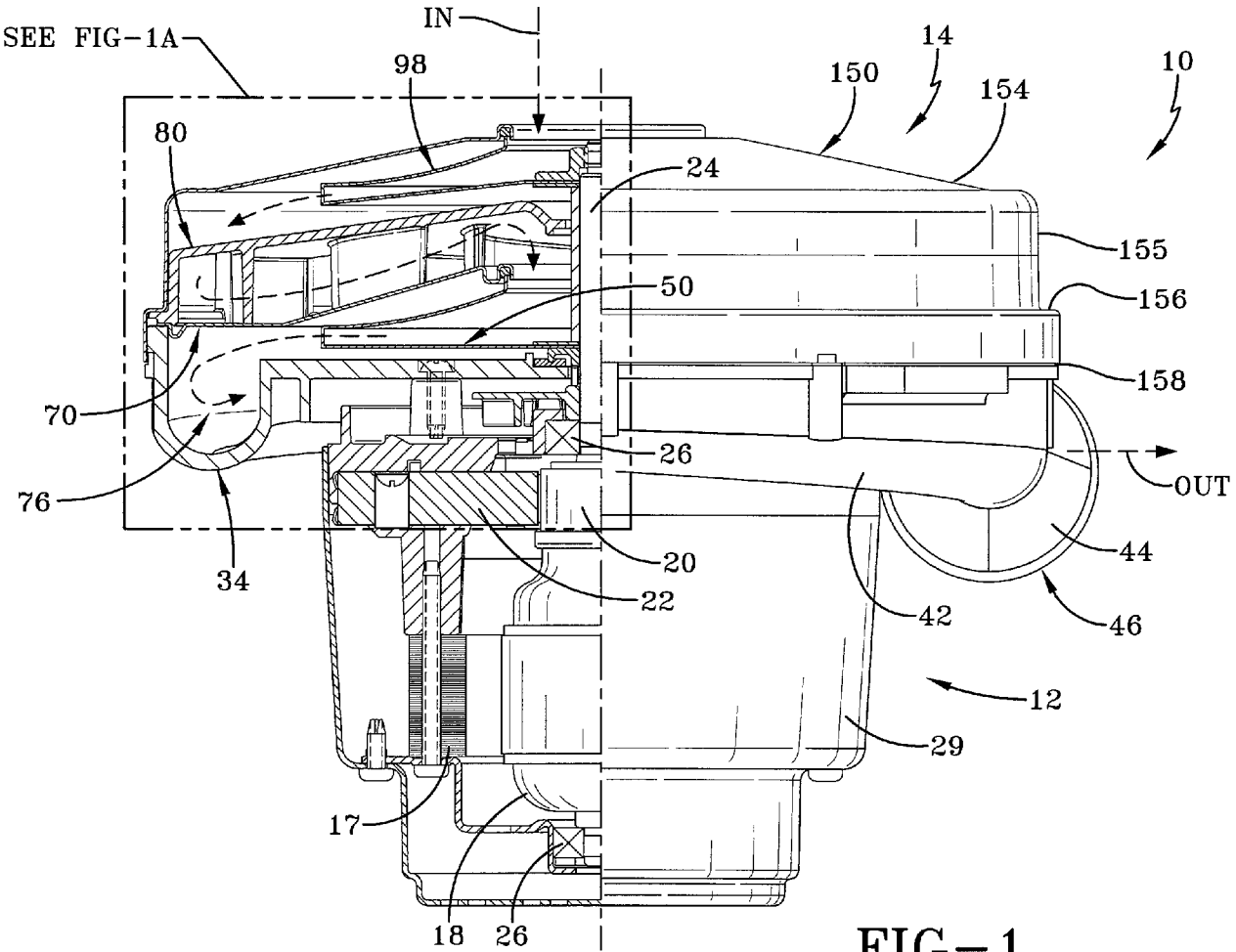
FIG. 1 is a partially sectioned front elevational view of a motor-fan unit according to the present invention showing the details of a motor assembly, an end plate assembly, a tapered fan, a diffuser assembly, and a tapered fan with a concave underside.
Figure 1A:
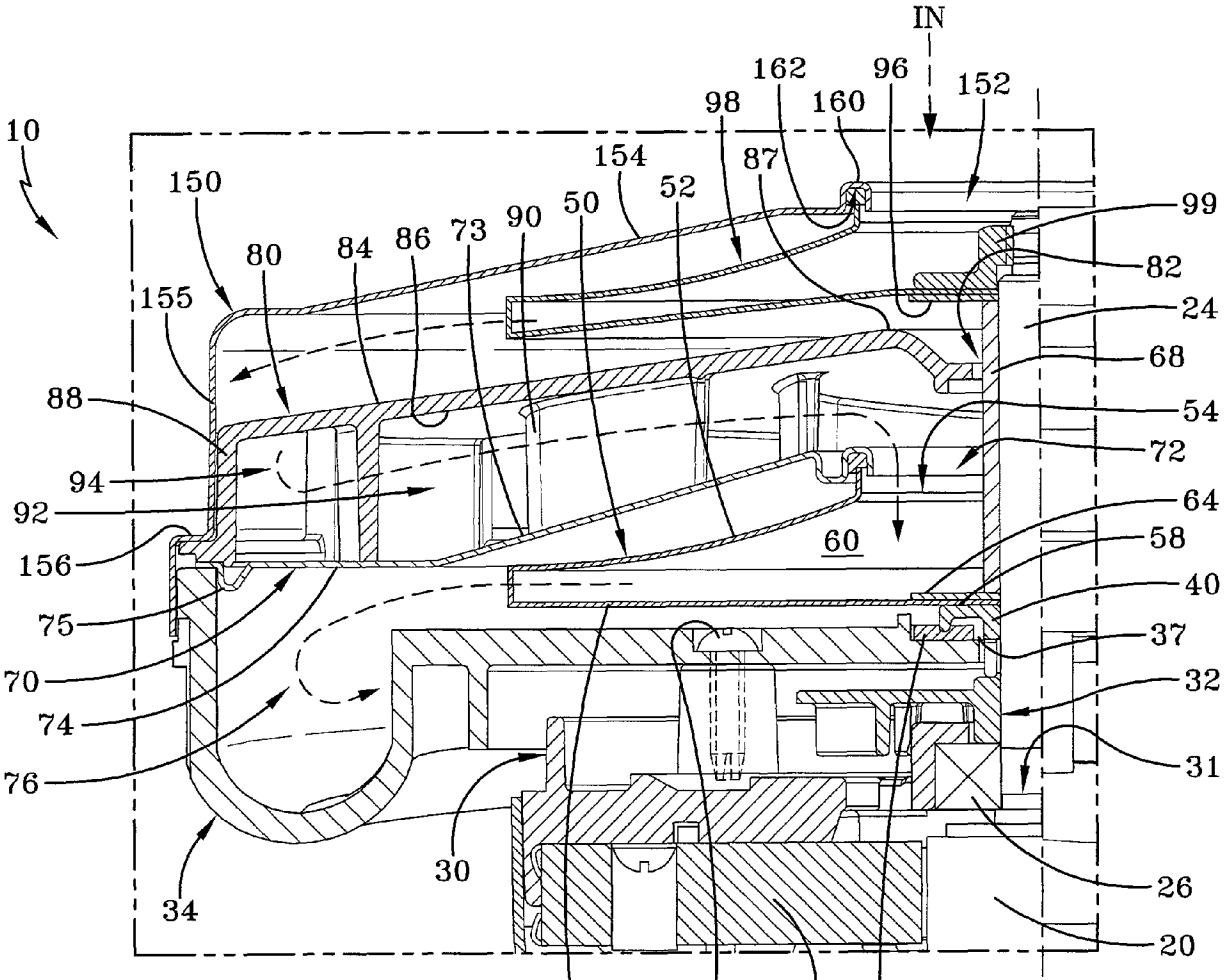
FIG. 1A is a detailed view of a portion of the cross-section of the motor-fan unit shown in FIG. 1.
Figure 2:
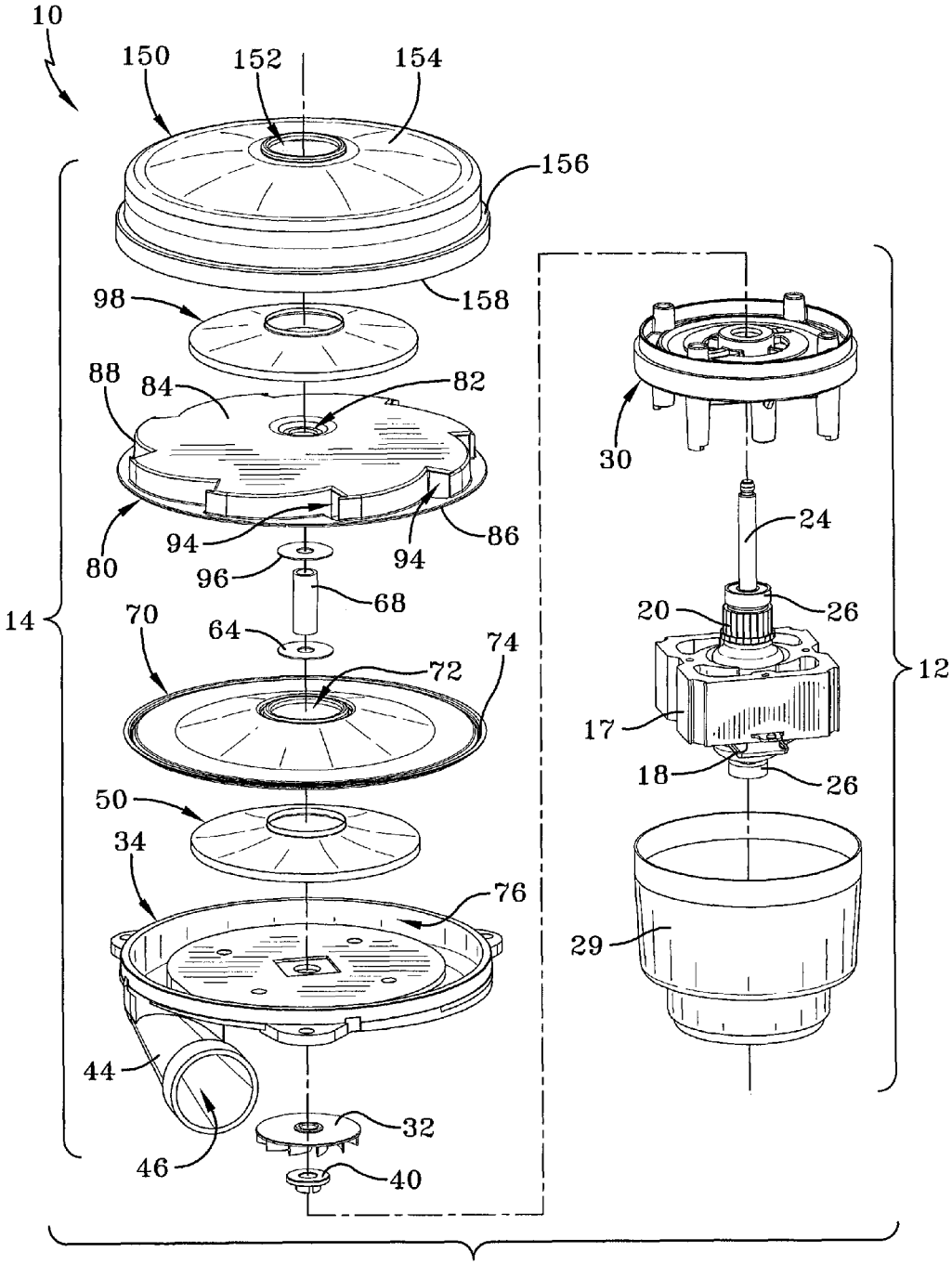
FIG. 2 is a top exploded perspective view of the motor-fan unit according to the present invention.
Figure 3:
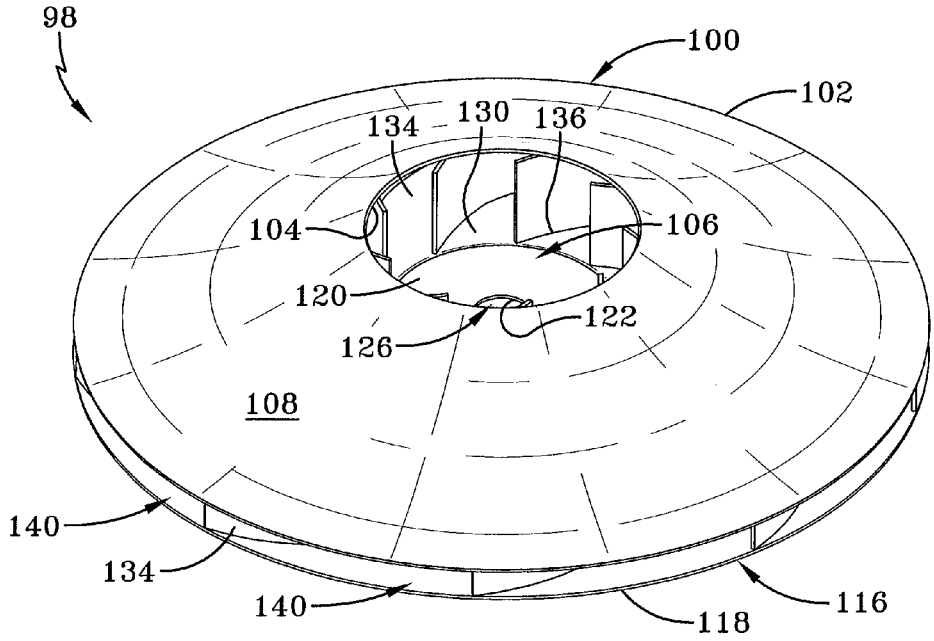
FIG. 3 is a top perspective view of the tapered fan with a concave underside maintained by the motor-fan unit shown in FIGS. 1 and 2.
Figure 4:
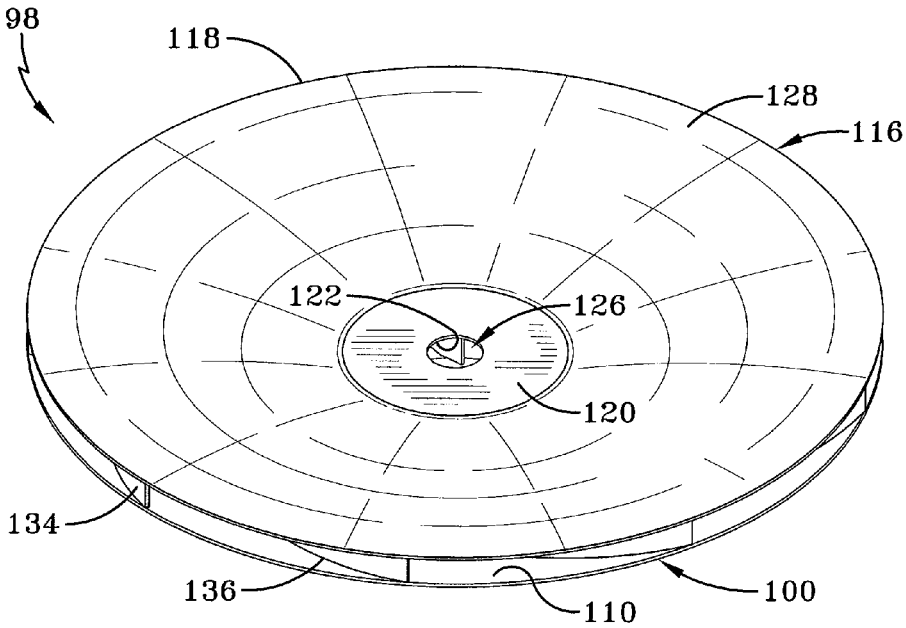
FIG. 4 is a bottom perspective view of the tapered fan with a concave underside maintained by the motor-fan unit shown in FIGS. 1 and 2.

A motor-fan unit, indicated generally by the numeral 10 in the accompanying FIGS. 1, 1A, and 2, generally includes a motor assembly 12 and a fan assembly 14. The motor assembly 12 includes a lamination stack 17, which comprises a plurality of laminations that support field windings (not shown). An armature 18, which also includes a commutator 20 at one end thereof, is rotatably received within the lamination stack 17. A shaft 24 carries the armature 18 and commutator 20 and axially extends from both ends thereof. The shaft 24 is supported by a bearing 26 within a bracket assembly at one end and by another bearing 26 at about a mid-point of the shaft, wherein the remaining portion of the shaft extends into the fan assembly 14. The skilled artisan will appreciate that a pair of brushes 22 are carried by the bracket assembly and contact the commutator 20. Application of electric current through the brushes and to the commutator 20 results in rotation of the shaft 24. A vented motor housing 29 surrounds the lamination stack 17, the armature 18, the commutator 20, the brushes 22 and any components related thereto.

An end plate assembly, designated generally by the numeral 30, is part of the motor assembly 12 and separates the brush, commutator and other motor assembly related components from the fan assembly 14. It will be appreciated that one side of the end plate assembly 30 faces the components of the motor assembly and carries the brushes 22 in a positional relationship so as to allow them to contact the commutator 20. An opposite side of the end plate assembly 30 faces the fan assembly 14, carries one of the bearings 26, and provides for attachment connections to the components of the fan assembly. It will be appreciated that the end plate assembly 30 has an opening 31 extending therethrough which rotatably receives the motor shaft 24. An internal cooling fan 32 is disposed between the end plate assembly 30 and the motor fan unit 14 and is secured to the shaft 24. As such, when the motor shaft 24 is rotated by the motor assembly, the vanes of the internal cooling fan 32 generate a minimal flow of air that is directed toward the motor windings maintained by the commutator and the armature and the lamination stacks so as to dissipate heat.

A discharge shell designated generally by the numeral 34 is secured to the end plate assembly 30 by fasteners 36. The discharge shell 34 has a shell opening 37 through which the motor shaft extends. A seal 38 is disposed about the opening 37 and a seal washer 40 is received over the shaft and rests upon the seal 38. The seal washer 40 may be constructed with lateral openings so as to allow for any moisture accumulated within the fan assembly to be drawn off by the internal cooling fan 32 and expelled radially away from the bearings 26. The discharge shell 34 forms a radial tube 42 about the outer periphery thereof and gradually expands so that air expelled by the fan unit assembly 14 collects within the radial tube and is exhausted out the exhaust horn 44 which has an outlet 46. Further details of the airflow through the fan assembly will be discussed as the description proceeds.

A tapered fan 50 is positioned and secured to the motor shaft and is supported by the seal washer 40. The fan 50 includes a fan ring 52 which is of a tapered construction and which provides an inlet 54. Opposed to the fan ring 52 is a fan disc 56 which has an aperture 58 extending therethrough and which is positionally received adjacent the motor shaft. A plurality of curvilinear and tapered fan blades 60 interconnect the fan disc 56 to the fan ring 52. The fan blades 60 are of a curvilinear construction. A washer 64 is disposed over the shaft and rests upon the fan disc 56. An elongated bushing 68 is also disposed over the motor shaft 24 and one end rests upon the washer 64. The other end of the bushing 68 extends substantially the entire length of the shaft 24 in a direction away from the motor assembly.

A tapered fan shell 70 is positioned over the shaft and has an outer edge or periphery that rests upon the discharge shell 34. Specifically, the fan shell 70 has a central aperture 72 which is aligned with and fitted over the fan ring inlet 54. The fan shell 70 is tapered in an area such that the angular orientation of the fan shell is substantially parallel to the fan ring 52 of the tapered fan 50. The fan shell 70 has a conical portion 73 extending from the aperture 72 and a flat portion 74 which extends from the conical portion 73. As best seen in FIG. 2, the conical portion 73 is substantially parallel with the fan ring 52 and the flat portion 74 extends from the end of the conical portion to an outer edge 75 which fits on the periphery of the discharge shell 34. In other words, the angular taper of the conical portion 73 is similar to the overall angular slope or taper of the fan ring 52. Together, when assembled, the discharge shell 34 and specifically the radial tube 42 form a chamber 76 which is of a radial configuration.

A tapered diffuser, designated generally by the numeral 80, is positioned on and supported by the tapered fan shell 70. The diffuser 80 has a shaft hole 82 extending therethrough which fits over the diameter of the bushing 68. The diffuser 80 has a fan side 84 which is of a tapered configuration and a shell side 86 which is opposite the fan side. The fan side 84 has an apex 87 from which the fan side 84 extends angularly downward from. The shell side 86 is disposed adjacent and is in contact with the tapered fan shell 70. Indeed, as will become apparent, portions of the shell side 86 are in contact with both the conical portion 73 and flat portion 74 of the fan shell 70. Disposed about the outer periphery of the diffuser is a scalloped outer periphery 88 which provides a transitional path from the fan side 84 to the shell side 86. Extending from the shell side 86 away from the fan side 84 are a plurality of curvilinear walls 90 which are of substantially equal height and fit on the fan shell to form a like number of channels 92. Each of these channels extend into ports 94 formed around the outer periphery 88. It will be appreciated that the shaft hole 82 is sized to frictionally fit over the outer diameter of the bushing 68 but is configured so as to not permit any significant air movement in between the shaft hole 82 and the outer diameter bushing. A support washer 96 is disposed atop the bushing 68 and around the outer diameter of the shaft 24.

A tapered fan 98, which has a convex underside, sits on the support washer and is secured to the shaft with a threaded nut 99. It will be appreciated that the end of the shaft has corresponding threads so as to allow for the nut 99 to secure the tapered fan 98 to the shaft. Securing the nut 99 to the shaft 24 secures both fans 98 and 50 to the shaft. Accordingly, rotation of the shaft by the motor assembly 12 causes rotation of the fans 98 and 50. Details of the tapered fan 98 and its operation in conjunction with the other components of the fan assembly 14 and motor assembly 12 will be discussed in detail.

A shroud 150 is disposed over and encloses the diffuser 80, the fan 50, the fan shell 70 and the tapered fan 98. The shroud 150 provides a central intake port 152 which is aligned with the motor shaft 24. The shroud 150 includes a cover portion 154 that is substantially conical in shape. Extending from the cover portion 154 is a side wall 155 which terminates at a step 156 that fits on the diffuser 80. The step 156 terminates at a rim edge 158 which fits upon the discharge shell 34. The intake port 152 is formed by a collar 160 which has an inlet channel 162 which is filled with friction material 164. This material engages a selected portion of the tapered fan 98 in a manner that will be discussed.

As shown in FIGS. 3-7, the tapered fan 98, which has a convex underside, includes a fan ring 100 which is provided in a substantially frusto-conical shape from its outer peripheral edge 102 to an inner edge 104. Extending through the ring 100 is an intake aperture 106, which is formed by the inner edge 104, wherein the aperture is substantially aligned with the intake port 152 of the shroud 150. The fan ring includes an external surface 108 which is positioned adjacent the underside of the shroud 150 and an internal surface 110 that is opposite the external surface 108.

The fan 98 also includes a fan disc 116 which also provides a substantially frusto-conical configuration similar to but not exactly the same as the fan ring 100. The fan disc 116 includes an outer peripheral edge 118 which is substantially aligned with the fan ring peripheral edge 102. The fan disc 116 also includes a flat attachment ledge 120 which provides an inner edge 122 that forms an attachment aperture 126 that extends through the fan disc 116. The attachment aperture 126 receives the motor shaft 24 in such a manner that the fan disc 116 and, as such, the assembled fan 98 is secured to the motor shaft by the nut 99. The fan disc 116 includes an internal surface 130 that faces the fan ring's internal surface 110. Opposite the internal surface 130 is an external surface 128 which faces the tapered diffuser 80. The flat attachment ledge 120 is sized so as to be slightly smaller in diameter than the intake aperture 106. The disc 116 includes a section 132 that is tapered from the outer periphery of the ledge 120 to the peripheral edge 118. In other words, the section 132 angularly extends from the ledge 120. As such, fan disc 116 forms an underside of the fan 98 which is concave. As a result of the fan disc 116 extending angularly downward, the peripheral edge 118 effectively overlaps the apex 87 of the tapered diffuser 80. In other words, the relative position of the edge 118 is lower in relation to the shaft 24 then the relative position of the apex 87. This overlap allows for the shaft length of the shaft 24 to be reduced and also allows for the shortening of the fan assembly height.

A plurality of curvilinear vanes 134 are mounted and secured between the fan ring 100 and the fan disc 116. Each curvilinear vane has an upper vane edge 136A and a lower vane edge 136B wherein each of the edges matches the respective contour of the facing ring 100 and disc 110. In other words, in addition to the vanes 134 having a curvilinear shape, each of the vane edges is shaped so as to match the contour of the surface which it contacts. As such, the upper vane edge 136A is contoured to match the internal surface 110 of the fan ring 100. Likewise, the lower vane edge 136B is contoured to match the internal surface 130 of the fan disc 116. Each edge 136 is provided with a number of stakes 138 which extend through corresponding openings provided in the fan ring 100 and fan disc 116. These stakes 138 are then stamped in such a manner so as to secure the fan disc, fan ring and vanes 134 to one another. Skilled artisans will appreciate that the stakes extend only a minimal distance, if at all, from the surface of the fan ring and fan disc so as to preclude undesirable air currents from forming. Other structural or mechanical type fasteners could be used to secure the vanes 134 to the fan ring and the fan disc such as spot welding, frictional fit, fasteners, and the like.

As the motor assembly rotates the shaft 24, it rotates the tapered fan which draws air in through the shroud intake port 152. After the air is expelled out the peripheral edges of the fan blades, the air rotates around and is received within the ports 94 of the tapered diffuser 80. These ports, which are on the outer periphery of the diffuser, receive the air which is then guided by the curvilinear vanes 90 to a central opening area and directed through the central aperture 72 of the tapered fan shell 70. This air flow is then directed into the tapered fan 50 and specifically the fan ring inlet 54. This air is then distributed through the channels formed by the adjacent fan blades 60 whereupon the air exits and enters the radial tube 42 and specifically the chamber 76 formed between the tapered fan shell 70 and the discharge shell 34. As the air gradually expands through this area, it exits the exhaust horn 44 at outlet 46.

The efficient flow of air through the fan unit is critical to the operation of the motor-fan unit. Any improvements in the operational efficiency of the fan 98 improve the life of the motor. To attain these efficiencies, the assembled fan 98 is thus provided with a relative top side that is convex and a relative underside which is concave. In other words, the side of the fan facing the shroud is convex and the side of the fan facing the diffuser and motor assembly is concave. As a result, the frusto-conical shapes of the fan disc and fan ring are aligned and substantially parallel to one another. The frusto-conical shapes of the fan ring and fan disc also improves air flow by not utilizing a sharp right angle turn of the incoming air as exhibited by prior art fan configurations. And the aligned parallel configuration of the ring and disc eliminates the deleterious dead space. These features improve airflow efficiency and help to extend motor life. Another feature of the vanes, the disc and the ring is that each vane 136 is tapered and curved so that the exhaust apertures formed thereby have an inlet and an outlet, wherein the exhaust aperture decreases in height from the inlet to the outlet and increases in width from the inlet to the outlet.

The ring 100, the disc 116 and the vanes 134 form a plurality of airflow apertures 140. It will be appreciated that the edges of the vanes 134 are tapered from one end at the inner edge 122 and the inner edge 104 to the outer peripheral edges 118/102 at an opposite end. As such, the airflow apertures 140 include an inlet proximal the intake aperture and an outlet proximate the outer peripheral edges 102 and 118. The gradual tapering of the airflow aperture's cross-sectional profile, in contrast to a fan having a substantially flat fan disc which has a much more severe cross-sectional transition, ensures optimal airflow therethrough. Accordingly, in operation of the fan 98 in the motor-fan unit 10, it will be appreciated that rotation of the shaft results in generation of an airflow that pulls air in through the inlet aperture of the shroud and the intake aperture of the fan wherein the airflow is directed through the apertures 140 and radially dispersed from the fan 128. The airflow from the fan then proceeds through the diffuser 80, the fan 50, and then the discharge shell 34. Further, as best seen in FIG. 7, the slope or curvilinear taper of the fan ring 100, from the inner edge 104 to the outer edge 102, is somewhat greater than the slope or curvilinear taper of the fan disc 116 from the outer periphery of the flat attachment ledge 120 to the outer peripheral edge 118. Although the slopes of both the ring and the disc could be substantially the same, it can be seen in the embodiment shown in FIG. 7, that the fan ring's slope is slightly greater than the fan disc's slope. This configuration permits a gradual increase in pressurization of air as it flows through the fan. This is in distinct contrast to the prior art convex ring/flat disc configuration which provides an abrupt change in pressurization that results in deleterious and inefficient airflow.

Another advantage of utilizing a tapered fan with a concave underside is that the fan is allowed to overlap with other components of the fan assembly. This overlap allows for the shaft length to be reduced in comparison to prior art configurations which, in turn, reduces flexing of the shaft. This allows the shaft to rotate at higher speeds and improve operation of the motor-fan unit.

Based upon the foregoing, the advantages of utilizing the fan 98 having a frusto-conical fan ring and fan disc allows for efficient and quiet air movement through the fan assembly. The airflow apertures 140 are configured so as to gradually increase pressurization of the air through the cross-sectional area from the inlet to the outlet so as to efficiently move the air without any air-flow anomalies that occur in prior art fan assemblies.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A motor-fan unit comprising:

an end plate assembly;

a motor assembly supported by said end plate assembly;

a shaft rotated by said motor assembly and extending through said end plate assembly;

a fan assembly supported by said end plate assembly, said fan assembly comprising a fan secured to said rotatable shaft;

said fan comprising:

a fan disc having a substantially frusto-conical shape;

a fan ring having a substantially frusto-conical shape; and a plurality of vanes connecting said fan disc to said fan ring such that the frusto-conical shapes are substantially parallel to one another;

a fan shroud mounted on said endplate assembly so as to substantially enclose said fan, said fan shroud having an intake port; and a diffuser interposed between said end plate assembly and said fan assembly, said diffuser having a tapered fan side positioned adjacent said fan disc and substantially parallel thereto.

2. The motor-fan unit according to claim 1, wherein said fan ring has an intake aperture extending therethrough which is aligned with said intake port.

3. The motor-fan unit according to claim 2, wherein said plurality of vanes, said fan disc, and said fan ring form a plurality of air flow apertures, wherein rotation of said shaft causes said fan to draw air in through said intake port into said intake aperture and exhaust air through said air flow apertures.

4. The motor-fan unit according to claim 3, wherein each said vane is tapered and curved such that said exhaust apertures have an inlet and an outlet, wherein said exhaust aperture decreases in height from said inlet to said outlet and increases in width from said inlet to said outlet.

5. The motor-fan unit according to claim 1, wherein said fan disc comprises a substantially flat attachment ledge and a tapered section angularly extending therefrom.

6. The motor-fan unit according to claim 5, wherein said substantially flat attachment ledge has an attachment aperture extending therethrough which receives said shaft which is secured to said substantially flat attachment ledge.

7. The motor-fan unit according to claim 1, wherein each of said vanes are curvilinear.

8. The motor-fan unit according to claim 1, wherein said fan shroud includes a tapered cover portion that is substantially parallel to said fan disc.

9. The motor-fan unit according to claim 1, wherein said tapered fan side has an apex and said fan disc has a peripheral edge which is relatively lower than said apex in relation to said shaft.

* * * * *